US005607224A

United States Patent [19]

Tobias et al.

[11] Patent Number: 5,607,224

[45] Date of Patent: Mar. 4, 1997

[54] PLASTIC NICHE AND GROUNDING ASSEMBLY THEREFOR

[75] Inventors: Samuel Tobias, Sheboygan, Wis.; Donald R. Davidson, Chatham; Robert H. Hanes, Rochelle Park, both of N.J.

[73] Assignee: H-Tech, Inc., Wilmington, Del.

[21] Appl. No.: 414,521

[22] Filed: Mar. 31, 1995

Related U.S. Application Data

[63] Continuation-in-part of Ser. No. 30,661, Mar. 12, 1993, Pat. No. 5,432,688.

[51] Int. Cl.[6] ..... F21V 25/00; F21V 31/00

[52] U.S. Cl. ..... 362/101; 362/267; 362/364; 362/310

[58] Field of Search ..... 362/267, 310, 362/101, 345, 145, 344, 153.1, 364, 294, 373; 119/245, 246; 4/253

[56] References Cited

U.S. PATENT DOCUMENTS

| | | | |
|---|---|---|---|
| 1,792,398 | 2/1931 | Rothen | 362/267 |
| 3,456,103 | 7/1969 | Bond | 362/267 |
| 3,949,213 | 4/1976 | Paitchell . | |
| 3,962,675 | 6/1976 | Rowley et al. | 362/101 |
| 4,281,367 | 7/1981 | Moore et al. | 362/267 |
| 4,460,944 | 7/1984 | Gordbegli et al. . | |
| 4,574,337 | 3/1986 | Poppenheimer | 362/267 |
| 4,779,174 | 10/1988 | Staten et al. . | |
| 5,050,052 | 9/1991 | Wade | 362/101 |

FOREIGN PATENT DOCUMENTS

| | | |
|---|---|---|
| 3121577 | 12/1982 | Germany . |
| 2021749 | 5/1979 | United Kingdom . |

OTHER PUBLICATIONS

American Products Commercial Literature, pp. 36–50, pertaining to pool lights and niches and bearing legend "Effective Nov. 1, 1994".

Hayward Pool Products, Inc. Commercial Literature entitled New Products '93 and indicating effective date of Nov. 15, 1992.

Sunsaver High Performance Lights, The Next Generation in Pool Lighting by Purex Pool Products, dated Oct., 1992.

*Primary Examiner*—Ira S. Lazarus
*Assistant Examiner*—Thomas M. Sember
*Attorney, Agent, or Firm*—Selitto & Associates

[57] ABSTRACT

A housing for an underwater lighting fixture includes a wet niche formed from plastic and provided with three alternative grounding pathways. A conductor strap is attached to the niche by a threaded lug which extends through the strap and an adjacent wall of the niche to permit an internal ground wire and an external ground wire to be connected to the strap. As a further grounding assurance, the lighting fixture is grounded through a bracket which attaches to the conductor strap. The bracket also serves as a current collector to receive electrical charge from the surrounding water.

23 Claims, 2 Drawing Sheets

PLASTIC NICHE AND GROUNDING ASSEMBLY THEREFOR

CROSS-REFERENCE TO RELATED APPLICATION

This is a continuation-in-part of application Ser. No. 08/030,661 filed Mar. 12, 1993 now U.S. Pat. No. 5,432,688.

FIELD OF THE INVENTION

The present invention relates to underwater lighting installations for swimming pools, spas and the like, and, more particularly, to wall-mounted niches (i.e., housings) for accommodating a lighting fixture of such installations.

BACKGROUND OF THE INVENTION

There are two basic types of underwater lighting installations for swimming pools, spas and the like. One type employs a dry "niche" or housing mounted in the wall of the pool below the water line for the purpose of receiving a lighting fixture. The dry niche is watertight so that pool water is prevented from surrounding the lighting fixture. The other type employs a wet niche, which is also a wall-mounted housing adapted to receive a lighting fixture, but which allows pool water to flow between the niche and the fixture.

Because a dry niche is designed to keep the lighting fixture dry, it must have a watertight seal which inhibits ready access for replacing bulbs, etc. In addition, since the seal must be maintained so as to prevent water from contacting the lighting fixture, it is necessary to service the lighting fixture from the rear of the niche. As can be imagined, these attributes of dry niches complicate manufacture, assembly and maintenance.

Certain disadvantages of dry niches are eliminated with a wet niche. For instance, because the lighting fixture of the wet niche is surrounded by water, there is no need for a watertight frontal seal. As a result, wet niches can be serviced from the front, rather than from the back.

Given the substantial electrical power required for standard lighting fixtures and the increased risk of shock associated with an aqueous environment, wet niches have been made from metal to guarantee adequate grounding (see, for instance, U.S. Pat. No. 4,460,944 and U.S. Pat. No. 3,949,213). In the past, U. L. code regulations have required that: (i) wet niches be made of electric conducting material; (ii) the lighting fixture be grounded through the connecting cord, as well as through the niche; and (iii) each niche be grounded to all other niches in the pool and to a suitable ground, e.g., a water pipe.

While plastic niches are in use in Europe, they are not provided with grounding assurances adequate under U.L. standards. This is due, at least in part, to the fact that the safety regulations imposed in Europe are less stringent than those imposed in the United States pursuant to U.L. code regulations.

Direct current pool lights that run on batteries have also been proposed for use in the United States and Europe. For example, U.S. Pat. No. 4,779,174 discloses a pool light with a plastic housing, the light being powered by direct current generated by flashlight batteries, as opposed to alternating current. Since the light uses such a small amount of power, there is little risk of electric shock associated with water infiltration and therefore grounding assurances are not needed.

SUMMARY OF THE INVENTION

The problems and disadvantages associated with conventional wet niches for underwater lighting fixtures are overcome by a new and improved niche which is made from electric insulating material, such as plastic, and which is provided with a plurality of alternative conductive pathways for conditionally grounding a lighting fixture in the event of a short. A first conductive pathway includes the lighting fixture shell and a first ground wire attached to the shell and passing through the niche to ground. A second conductive pathway includes a first conductor element attached to the shell, a second conductor element connecting proximate a first end thereof to the first conductor element, a lug extending through a wall of the niche and attached to the second conductor element proximate a second end thereof and a second ground wire attached to the lug, the second ground wire attaching to the lug externally of the niche. A third conductive pathway includes the first conductor element, the second conductor element, the lug and a third ground wire. The third ground wire is attached to the lug internally to the niche and runs through the niche to ground. The first conductor element provides a junction for connecting the first, second and third grounding pathways to compensate for discontinuities arising in one of the pathways by conducting current to ground via another of the pathways.

Another improvement provided by the present invention involves an adjustable outlet for the internal ground wire. The outlet includes an opening delimited by a socket which extends outwardly from the niche. An elbow fitting is rotatably received within the socket, while a slip fitting is removably received within the elbow fitting. By rotating the elbow fitting, an installer can vary the orientation of the elbow fitting relative to the niche. Different size electrical conduits can be attached to the niche depending upon whether or not the slip fitting is employed.

BRIEF DESCRIPTION OF THE DRAWINGS

For a better understanding of the present invention, reference is made to the following detailed description of an exemplary embodiment of the invention, considered in conjunction with the accompanying drawings, in which.

DESCRIPTION OF THE EXEMPLARY EMBODIMENT

Figure 1:
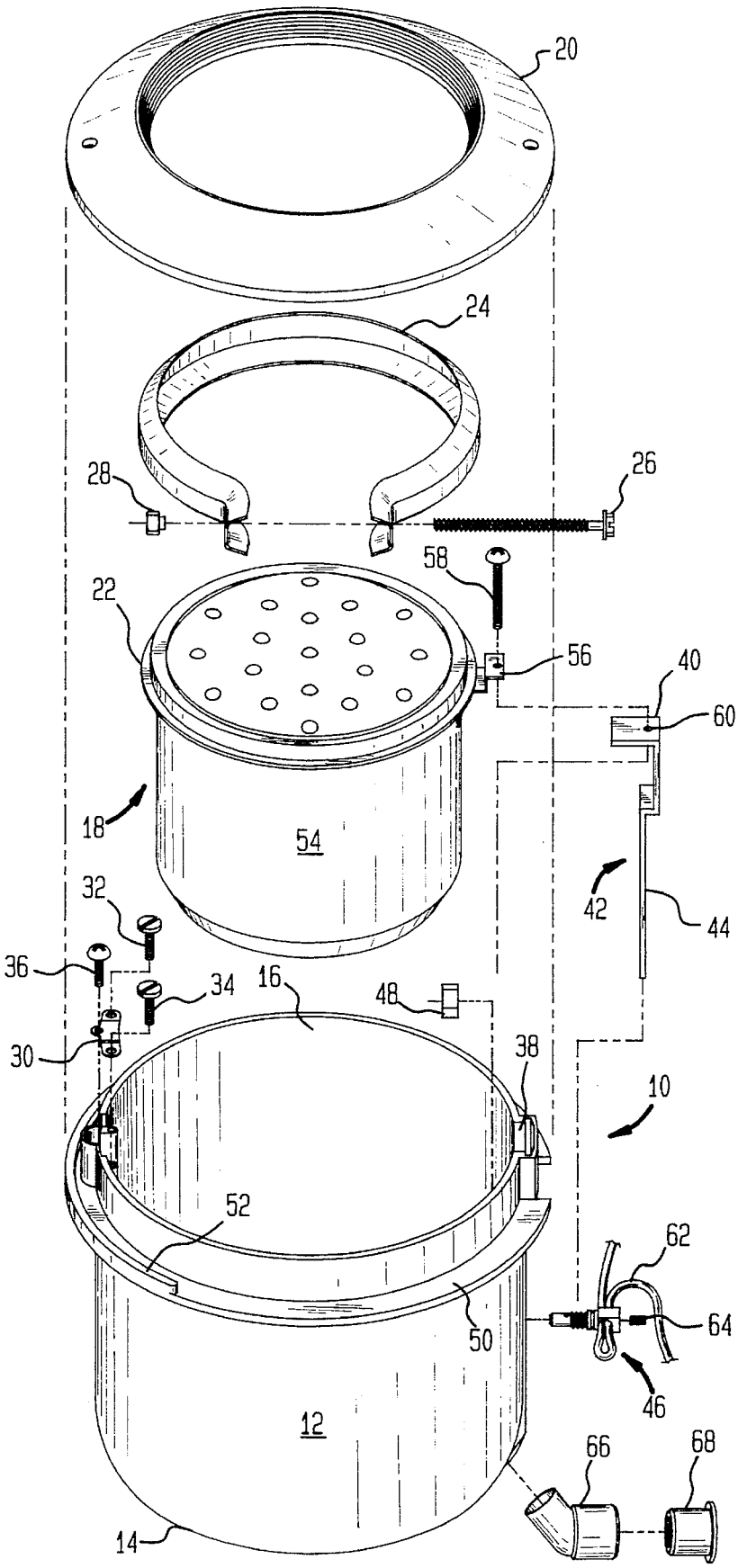
FIG. 1 is an exploded perspective view of a plastic niche and lighting fixture assembly constructed in accordance with an exemplary embodiment of the present invention.

FIG. 1 shows a niche 10 which includes a housing 12 preferably formed of plastic by injection molding or an equivalent process and having a closed end 14 and an open end 16. A lighting fixture 18 is received within the housing 12 through the open end 16 thereof. As shall be described in greater detail below, the lighting fixture 18 functions to provide underwater illumination for a pool in which it is installed. An escutcheon ring 20 is joined to an upper flanged end 22 of the lighting fixture 18 by a ring clamp 24 and an associated bolt 26 and a mating nut 28. The ring 20 may be formed of plastic or metal. Proximate the open end 16 of the housing 12, the niche 10 has a mounting plate 30 which is affixed by self-threading screws 32, 34 and which threadedly receives a fastener 36, such as a screw or bolt, for joining the escutcheon ring 20 to the niche 10 (see FIG. 2). In the alternative, plate 30 may coact with a hook member associated with the ring 20 to retain the ring in position, as is common in the art.

Diametrically opposite the mounting plate 30, the housing 12 has a recess 38 sized and shaped to receive a short leg 40 of a generally "L"-shaped grounding strap 42. The grounding strap 42 also has a long leg 44, which includes a hole (not visible in FIG. 1) positioned so as to be in alignment with a corresponding hole (not visible in FIG. 1) provided in the side of the housing 12 when the short leg 40 of the grounding strap 42 is in place in the recess 38. A grounding lug 46 extends through the aligned holes in the housing 12 and the grounding strap 42 and threadedly receives a nut 48 disposed in the interior of the niche 10 for drawing the grounding lug 46 and the grounding strap 42 into snug mechanical and electrical contact to ensure a low-resistance, electrically-conductive pathway. The short leg 40 of the grounding strap 42 has a length of about ¾ of an inch and a width of about ¼ inches, while the long leg 44 of the grounding strap 42 has a length of about 5 inches and a width of about ¼ inches.

Because the niche 10 is designed for installation within the wall of an inground pool, the housing 12 has a flange 50 which can be imbedded in the concrete or gunite of the pool wall, thereby anchoring the housing 12 in place. A retainer lip 52 projects from the flange 50 in order to promote the retainment of finishing plaster when the niche 10 is being installed in a horizontal position.

The lighting fixture 18 has an outer shell 54 which is made from metal and which has a mounting bracket 56 rigidly affixed thereto by, for instance, welding. In the alternative, the bracket 56 may be eliminated if the escutcheon ring 20 is metal. In that instance, the escutcheon ring 20 will be conductively connected to the metal shell 18 via clamp ring 24 and screw 58 passing through the ring 20 will complete a conductive pathway to the strap 42. When used, the mounting bracket 56 receives a bolt 58, which is threaded into a bore 60 in the short leg 40 of the grounding strap 42 to thereby draw the mounting bracket 56 into an electrically conductive relationship with the grounding strap 42 and to also mechanically attach the lighting fixture 18 to the housing 12 of the niche 10.

The grounding lug 46 has a transverse hole (see FIG. 2) sized and shaped to receive a looped portion of a bonding wire 62. The looped portion of the bonding wire 62 is clamped in place by a set screw 64.

An elbow firing 66 and a slip fitting 68 are employed to provide an adjustable conduit for electric feed and ground lines entering the niche 10. The elbow fitting 66 and the slip fitting 68 will be described in greater detail below.

Figure 2:
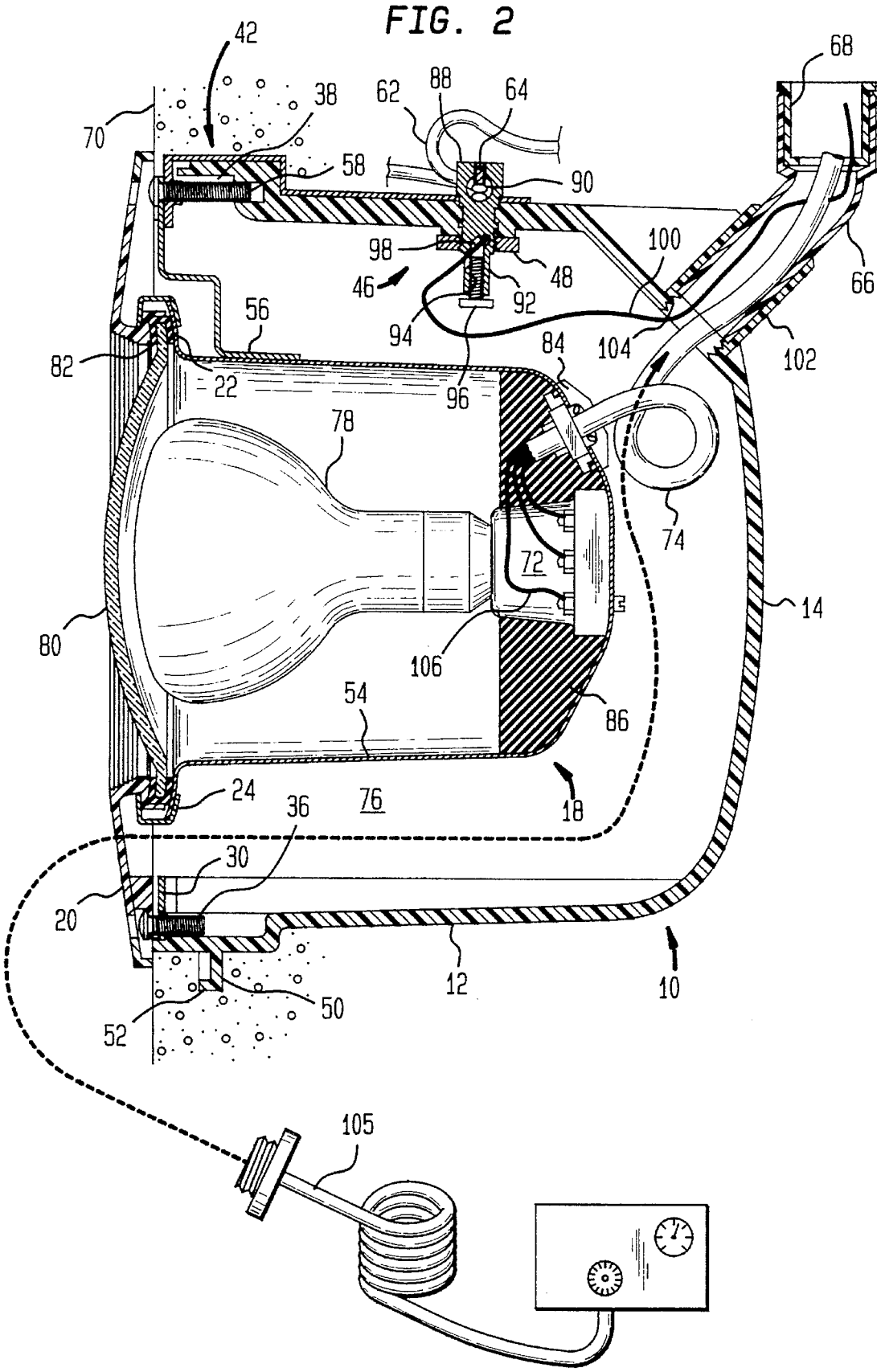
FIG. 2 is a cross-sectional view of the plastic niche and lighting fixture assembly of FIG. 1 installed in a pool wall.

FIG. 2 shows the niche 10 installed within a wall 70 of an inground pool. An incandescent light socket 72 is provided within the shell 54 of the lighting fixture 18 and is held in place by welding, riveting, bolts or any other conventional means. A power cable 74, which supplies at least about 500 Watts of power, passes through the slip fitting 68 and the elbow fitting 66 and then into the housing 12 of the niche 10. A space 76 between the interior surface of the housing 12 and the shell 54 of the lighting fixture 18 accommodates water which serves to cool the lighting fixture 18 when it is heated by an incandescent bulb 78. Typically, the power cable 74 is coiled or wrapped around the shell 54 of the lighting fixture 18 to facilitate servicing.

As can be seen, the shell 54 of the lighting fixture 18 is sealed by virtue of a lens plate 80 and a gasket 82, which cooperate to prevent water from entering the shell 54. In addition, a cable seal 84 is provided to prevent water from entering the shell 54 at the point of entry of the power cable 74. For similar reasons, the socket 72 and connections to the power cable are pored with potting material 86.

A grounding arrangement in accordance the present invention is depicted in FIG. 2, wherein the short leg 40 of the grounding strap 42 is connected to the mounting bracket 56 by the bolt 58. The long leg 44 of the grounding strap 42 accommodates the grounding lug 46, which extends through the strap 42 and the housing 12 and which is secured by nut 48. Tightening of the nut 48 assures a good electrical and mechanical connection between the grounding strap 42 and the lug 46. The embodiment utilizing a metal escutcheon ring is essentially the same as that depicted, except that bolt 58 compresses the ring 20 against the wall 70 and bracket 56 is unnecessary. However, in the event that an additional grounding assurance is desired to protect against a degradation of the metal ring 20/bolt 58 interface, bracket 56 can be retained as a redundant ground.

The grounding lug 46 is externally threaded so as to threadedly engage the nut 48 and has a faceted head 88 designed to facilitate tightening with a wrench. The head 88 of the grounding lug 46 has a transverse hole 90 sized and shaped to receive the bonding wire 62, which connects the niche 10 to adjacent niches and to an electrical ground. The diameter of the hole 90 is large enough so that the bonding wire 62 can be doubled over onto itself and still be inserted into the hole 90 where it is clamped in place by the set screw 64. The grounding lug 46 has a stem 92, which is provided with an axial bore 94 adapted to receive a set screw 96. An oblique bore 98 in the stem 92 receives a grounding wire 100, which is clamped in place by the set screw 96. An O-ring (not shown) may be used to effect a seal between the grounding lug 46 and the housing 12 of the niche 10. As can be appreciated, the bonding wire 62 and the grounding wire 100 cooperate to form a double grounding path.

A socket 102 is provided in the housing 12 for admitting the power cable 74 and the grounding wire 100. In the embodiment shown, the socket 102 is arranged at approximately a 45 degree angle relative to the longitudinal axis of the niche 10 and receives the elbow fitting 66, which can be bonded to the socket 102 by a suitable adhesive. The elbow fitting 66 can be rotated through 360 degrees prior to its attachment to the socket 102, whereby its outlet end is oriented in a manner which suits the needs of a particular installation. A threaded portion 104 of the socket 102 allows an installer to pressure test conduit connections before installing the power cable 74 by, for instance, attaching a sealing plug or a threaded air pressure line 105 to the housing 12 of the niche 10. The slip fitting 68, which can also be adhesively affixed to the elbow fitting 66, facilitates the connection of the niche 10 to electrical conduit by serving as an adapter for different conduit diameters. It should be understood that the elbow fitting 66 and the slip fitting 68 are optional elements and can be omitted, depending on installation requirements.

A third grounding assurance is typically provided in that the power cable 74 is a three wire cable and includes a grounding wire 106 which is attached to the shell 54 of the lighting fixture 18 internally. The grounding wire in the power cable 74 leads to a ground associated with the source of electricity, such as a grounded, three-prong outlet.

It should be understood that the embodiment described herein is merely exemplary and that a person skilled in the art may make many variations and modifications without departing from the spirit and scope of the invention as defined in the appended claims. For example, whereas a generally cylindrical niche for use in an inground pool is disclosed herein, the niche can be of any shape which adequately accommodates a corresponding lighting fixture and may be adaptable using well known techniques and designs to an above ground pool. Moreover, while a metal lighting fixture shell is shown, a plastic shell with comparable grounding assurances could be employed with the niche of the present invention. Thus, all such variations and modifications are intended to be included within the scope of the invention as defined in the appended claims.

We claim:

1. In a wet underwater lighting niche for housing an electric-powered lighting fixture with a cup-like metal shell in a wall of a swimming pool, spa or the like, the improvement wherein said niche is made from an electric insulating material and wherein said niche includes a plurality of alternative conductive pathways for conditionally grounding said lighting fixture in the event of a short, a first said alternative conductive pathway including said shell and a first ground wire attached to said shell and passing through said niche to ground, a second said alternative conductive pathway including a first conductor element attached to said shell, a second conductor element connected proximate a first end thereof to said first conductor element, a lug extending through a wall of said niche and attached to said second conductor element proximate a second end thereof and a second ground wire attached to said lug, said second ground wire attached to said lug externally of said niche, and a third said alternative conductive pathway including said first and second conductor elements, said lug and a third ground wire, said third ground wire attached to said lug internally to said niche and running through said niche to ground, said first conductor element providing a junction for connecting said first, second and third grounding pathways to compensate for discontinuities arising in one of said pathways by-conducting current to ground via another of said pathways.

2. In a wet underwater lighting niche for housing an electric-powered lighting fixture, which includes a cup-like shell having electrical conducting capabilities, in a wall of a swimming pool, spa or the like, the improvement wherein said niche is made from an electric insulating material and wherein said niche includes a plurality of alternative conductive pathways for conditionally grounding said lighting fixture in the event of a short, a first said alternative conductive pathway including said shell and a first ground wire attached to said shell and passing through said niche to ground, a second said alternative conductive pathway including a first conductor element attached to said shell, a second conductor element connected proximate a first end thereof to said first conductor element, a lug extending through a wall of said niche and attached to said second conductor element proximate a second end thereof and a second ground wire attached to said lug, said second ground wire attached to said lug externally of said niche, and a third said alternative conductive pathway including said first and second conductor elements, said lug and a third ground wire, said third ground wire attached to said lug internally to said niche and running through said niche to ground, said first conductor element providing a junction for connecting said first, second and third grounding pathways to compensate for discontinuities arising in one of said pathways by conducting current to ground via another of said pathways.

3. The improved niche of claim 1 or 2, wherein said plurality of alternative conductive pathways are insulated to prevent a user of said pool from contacting said conductive pathways.

4. The improved niche of claim 3, wherein said plurality of alternative conductive pathways are insulated from said user by a plastic escutcheon framing said niche.

5. The improved niche of claim 4, wherein said insulating material is plastic.

6. The improved niche of claim 1 or 2, wherein said first conductor element is a mechanical support for retaining said shell in said niche.

7. The improved niche of claim 6, wherein said second conductor element is a conductor strap and also provides a mechanical support to retain said lighting fixture in said niche.

8. The improved niche of claim 7, wherein said lug includes an externally-threaded portion intermediate said ends thereof, said externally-threaded portion having external threads which cooperate with mating internal threads of an internally-threaded nut to mechanically and electrically connect said lug to said strap and to affix said strap to said niche.

9. The improved niche of claim 8, wherein said lug includes first receiving means in one end thereof for receiving said first ground wire and second receiving means in an opposite end of said lug for receiving said second ground wire.

10. The improved niche of claim 9, further comprising an elbow fitting having a first end received within a socket opening in said niche and a second end extending outwardly from said socket, said first end of said elbow fitting being rotatable relative to said socket, whereby the orientation of said second end of said elbow fitting relative to said niche can be varied.

11. The improved niche of claim 10, further comprising a slip fitting removably received in said second end of said elbow fitting.

12. The improved niche of claim 11, wherein said second end of said elbow fitting has a first diameter selected so as to be compatible with one size electrical conduit and wherein said slip fitting has a second diameter, selected so as to be compatible with another size electrical conduit.

13. The improved niche of claim 12, wherein said socket includes connecting means for releasably connecting said niche to a pressure-testing appliance.

14. The improved niche of claim 6, wherein said first conductor element is a metal bracket.

15. The improved niche of claim 1 or 2, wherein said niche has an outwardly extending peripheral flange sized and shaped so as to anchor said niche in a concrete wall, said flange including an annular lip disposed on a lower portion of said peripheral flange projecting at about 90 degrees relative thereto and towards said swimming pool to retain wet plaster during installation of said niche.

16. The improved niche of claim 1 or 2, wherein said conductor strap is disposed substantially outside said niche.

17. The improved niche of claim 16, wherein said conductor strap is positioned substantially parallel to an outer wall of said niche and has a hole at one end thereof for receiving said lug.

18. The improved niche of claim 17, wherein said conductor strap substantially conforms to the exterior surface of said niche over which it traverses.

19. The improved niche of claim 18, wherein said conductor strap is substantially "L" shaped with the long leg of the L being that portion of said strap conforming to said niche exterior surface and with the short leg pointing inward to a central axis of said niche and having a threaded aperture therein for receiving a screw that connects said bracket to said conductor strap.

20. The improved niche of claim 19, wherein said conductor strap is embraced by the pool wall in which said niche is installed.

21. The improved niche of claim 20, wherein said conductor strap is formed from a corrosion resistant metal.

22. The improved niche of claim 21, wherein said conductor strap is stainless steel.

23. The improved niche of claim 2, wherein said cup-like shell is made from plastic and includes its own grounding means.

* * * * *